US010310416B2

(12) United States Patent
Sasaki et al.

(10) Patent No.: US 10,310,416 B2
(45) Date of Patent: Jun. 4, 2019

(54) SEAL MEMBER, UNIT, AND IMAGE FORMING APPARATUS

(71) Applicant: CANON KABUSHIKI KAISHA, Tokyo (JP)

(72) Inventors: Hiraku Sasaki, Susono (JP); Hiroomi Matsuzaki, Mishima (JP); Kazuki Matsumoto, Fuji (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/407,324

(22) Filed: Jan. 17, 2017

(65) Prior Publication Data

US 2017/0219962 A1 Aug. 3, 2017

(30) Foreign Application Priority Data

Jan. 29, 2016 (JP) ..... 2016-014998

(51) Int. Cl.
*G03G 15/08* (2006.01)

(52) U.S. Cl.
CPC ..... *G03G 15/0898* (2013.01)

(58) Field of Classification Search
None
See application file for complete search history.

(56) References Cited

U.S. PATENT DOCUMENTS

| | | | | |
|---|---|---|---|---|
| 5,475,467 | A | 12/1995 | Watanabe et al. | |
| 5,697,021 | A | 12/1997 | Watanabe et al. | |
| 2001/0021318 | A1* | 9/2001 | Hashimoto ..... | G03G 15/0817 399/103 |

FOREIGN PATENT DOCUMENTS

| | | | |
|---|---|---|---|
| JP | H04-243277 | A | 8/1992 |
| JP | H07-013390 | A | 1/1995 |

* cited by examiner

*Primary Examiner* — Victor Verbitsky
(74) *Attorney, Agent, or Firm* — Venable LLP

(57) ABSTRACT

A seal member 14 which seals a gap among a rotating body 9 provided in an opening of a frame body 13, a blade 18*a*, and the frame body 13 in an end region in an axial direction of the rotating body 9, the seal member 14 including: a first seal portion 14*b* which comes into contact with the rotating body 9; a second seal portion 14*e* which comes into contact with the blade 18*a*; and a third seal portion 14*f* which is constituted by a surface formed in a stair shape and sequentially arranged between the first seal portion 14*b* and the second seal portion 14*e* and which is capable of reducing a gap formed between the rotating body 9 and the blade 18*a* due to rotation of the rotating body 9.

15 Claims, 11 Drawing Sheets

SEAL MEMBER, UNIT, AND IMAGE FORMING APPARATUS

BACKGROUND OF THE INVENTION

Field of the Invention

The present invention relates to a seal member in an image forming apparatus and in a process cartridge.

Description of the Related Art

Units such as a developing apparatus and a process cartridge which constitute an electrophotographic image forming apparatus (hereinafter, an image forming apparatus) are configured such that a cleaning blade, a developing blade, and the like are brought into contact with a rotating body such as a photosensitive drum and a developing roller. With such units, in order to prevent a developer from leaking, a seal member is provided at ends in an axial direction of a rotary shaft of a photosensitive drum, a developing roller, and the like. Seal members using an elastic body such as an elastomer are known as such seal members (for example, refer to Japanese Patent Application Laid-open No. H04-243277 and Japanese Patent Application Laid-open No. H07-013390).

SUMMARY OF THE INVENTION

Usually, when providing a rotating body with a seal member and causing the seal member to exhibit seal performance, an abutment portion shape of the seal member may be determined so as to follow an external shape of the rotating body. However, when desiring seal performance to be exhibited with respect to a blade in addition to the rotating body, the abutment portion shape of the seal member must be determined so as to follow not only the external shape of the rotating body but also a shape of the blade. In other words, sufficient seal performance must be exhibited when in sliding contact with the rotating body which is a rotating member and, at the same time, sufficient seal performance must be exhibited when in contact with the blade which is a fixed member. In addition, since a fine movement of the blade may occur due to sliding relative to the rotating body even though the blade is fixed to a frame body, the seal member must also have followability with respect to such state changes. As described above, producing perfect seal performance with respect to two members with different properties as seal objects is no easy task. In particular, since it is difficult to arrange the seal member all the way to a corner portion of a stepped portion formed by a blade tip and the rotating body, sufficient seal performance may not always be exhibited.

A seal configuration disclosed in Japanese Patent Application Laid-open No. H04-243277 only assumes sealing between a rotating body and a frame body and does not consider a blade as a seal object. Therefore, with a seal member disclosed in Japanese Patent Application Laid-open No. H04-243277, while seal performance can be expected with respect to a rotating body, there is a possibility that seal performance cannot be exhibited with respect to a stepped portion formed by the blade tip and the rotating body described above. In addition, while a seal configuration disclosed in Japanese Patent Application Laid-open No. H07-013390 exhibits seal performance with respect to both a rotating body and a blade, a component specifically targeting the stepped portion described above is not provided. Therefore, with a seal member disclosed in Japanese Patent Application Laid-open No. H07-013390, there is a possibility that sufficient seal performance cannot be exhibited with respect to the stepped portion and particularly all the way to a corner portion thereof.

An object of the present invention is to provide a technique enabling an occurrence of a gap that causes leakage of a developer in a developer housing portion to be more effectively suppressed.

In order to achieve the object described above, a seal member according to an embodiment of the present invention is a seal member formed of an elastic body and used in a unit or an image forming apparatus including a frame body which is provided with a housing portion for housing a developer, a rotating body which is provided in an opening of the housing portion of the frame body, and a blade which comes into contact with a surface of the rotating body, the seal member being provided on the frame body in order to prevent the developer from leaking out from a gap among the frame body, the rotating body, and the blade in an end region of the opening in an axial direction of a rotary shaft of the rotating body, the seal member comprising:

a first seal portion which comes into contact with the rotating body;

a second seal portion which comes into contact with the blade; and a third seal portion which is constituted by a surface formed in a stair shape and sequentially arranged between the first seal portion and the second seal portion and which causes a gap formed between the rotating body and the blade to decrease due to rotation of the rotating body.

In order to achieve the object described above, a seal member according to an embodiment of the present invention is a seal member formed of an elastic body and used in a unit or an image forming apparatus including a frame body which is provided with a housing portion for housing a developer, a rotating body which is provided in an opening of the housing portion of the frame body, and a blade which comes into contact with a surface of the rotating body, the seal member being provided on the frame body in order to prevent the developer from leaking out from a gap among the frame body, the rotating body, and the blade in an end region of the opening in an axial direction of a rotary shaft of the rotating body, the seal member comprising:

a first seal portion which comes into contact with the rotating body;

a second seal portion which comes into contact with the blade; and a third seal portion which comes into contact with (i) an end surface, disposed in a tip portion of the blade, with which the second contact portion does not come into contact and (ii) a region, disposed in a surface of the rotating body adjacent to the end surface, with which the first seal portion does not come into contact, wherein the third seal portion is capable of assuming:

a first state where the third seal portion has a gap in relation to the rotating body and the blade, the gap being such that a distance between the third seal portion and the tip surface broadens gradually in a rotation direction of the rotating body towards the region on the surface of the rotating body; and a second state where the gap has been narrowed or the gap has been filled.

In order to achieve the object described above, a unit according to an embodiment of the present invention is a unit attachable to and detachable from an apparatus main body of an image forming apparatus, the unit comprising:

a frame body which is provided with a housing portion for housing a developer;

a rotating body which is provided in an opening of the housing portion of the frame body;

a blade which comes into contact with a surface of the rotating body; and the seal member.

In order to achieve the object described above, an image forming apparatus according to an embodiment of the present invention is an image forming apparatus, comprising:

a frame body which is provided with a housing portion for housing a developer;

a rotating body which is provided in an opening of the housing portion of the frame body;

a blade which comes into contact with a surface of the rotating body so as to restrict an amount of the developer, borne by the rotating body, which is carried outside through the opening; and the seal member.

According to the present invention, an occurrence of a gap that causes leakage of a developer in a developer housing portion can be more effectively suppressed.

Further features of the present invention will become apparent from the following description of exemplary embodiments with reference to the attached drawings.

DESCRIPTION OF THE EMBODIMENTS

Modes for carrying out the present invention are illustratively explained in detail below on the basis of embodiments with reference to the drawings. However, dimensions, materials, and shapes of components described in the embodiments, relative arrangement of the components, and the like should be changed as appropriate according to the configuration of an apparatus to which the invention is applied and various conditions. That is, the dimensions, the materials, the shapes, and the relative arrangement are not intended to limit the scope of the present invention to the embodiments.

First Embodiment

The present invention relates to a developing apparatus, a developing cartridge, and a process cartridge, and to an image forming apparatus using these components. A developing apparatus refers to an apparatus which includes a developing roller (a developer bearing member) that bears a developer on a surface thereof and which uses the developer to convert an electrostatic latent image (an electrostatic image) formed on a photosensitive drum (an image bearing member) by the developing roller into a visible image. A developing cartridge is the developing apparatus made into a cartridge as an integrated unit and is attachably and detachably mounted to an image forming apparatus main body. In addition, a process cartridge refers to a cartridge made up of a photosensitive drum and a developing apparatus that acts on the photosensitive drum as an integrated unit and is attachably and detachably mounted to an image forming apparatus main body. Furthermore, an image forming apparatus refers to an apparatus that forms an image on a recording medium (a recording material) such as a sheet material using an electrophotographic image forming system.

Examples of an electrophotographic image forming apparatus include an electrophotographic copier, an electrophotographic printer (such as an LED printer and a laser beam printer), a facsimile device, and a word processor.

(Overall Configuration of Image Forming Apparatus)

Figure 2:
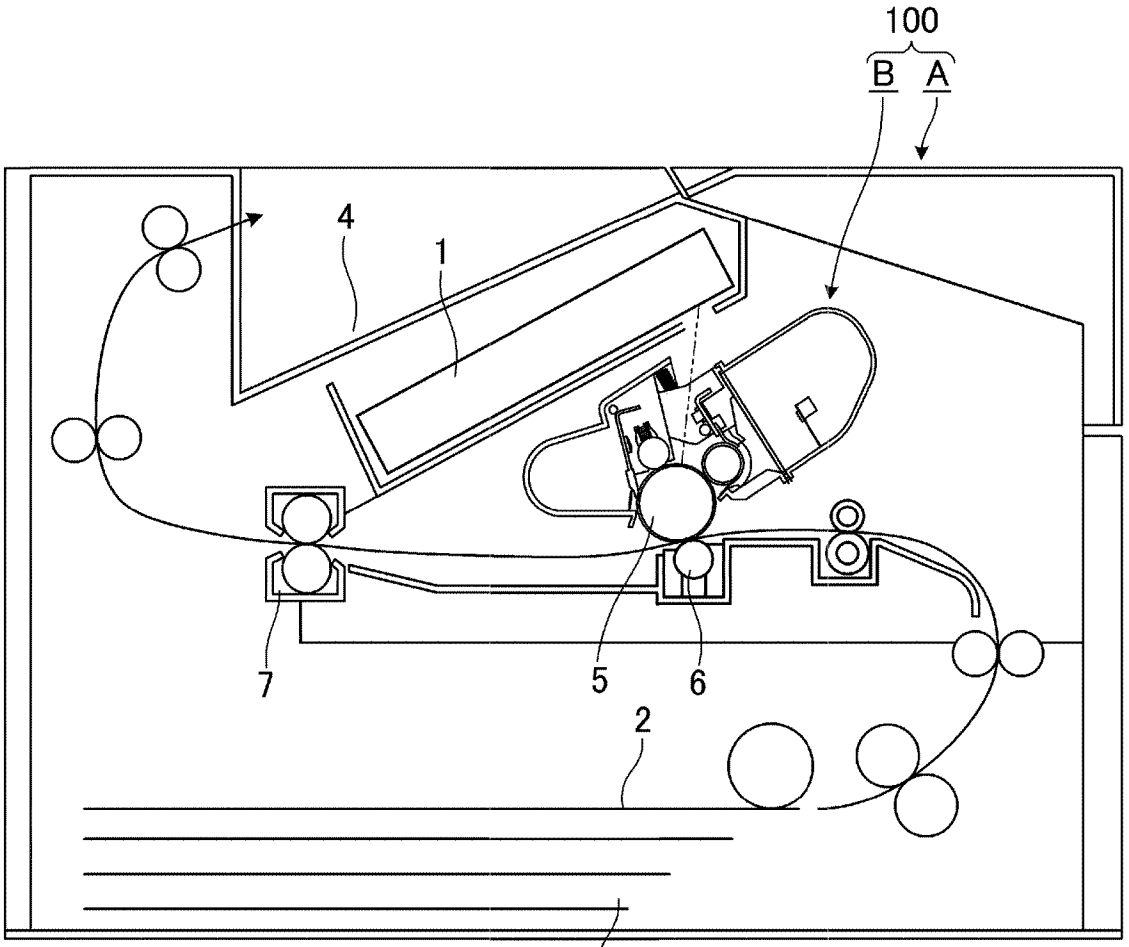
FIG. 2 is a schematic sectional view of an image forming apparatus according to an embodiment of the present invention.

FIG. 2 is a schematic sectional view showing a configuration of an image forming apparatus 100 according to the present embodiment in a state where a process cartridge B is mounted to an image forming apparatus main body A (hereinafter, an apparatus main body A). With the image forming apparatus 100, exposing means 1 irradiates information light (laser light, LED light, or the like) based on image information on a photosensitive drum 5 which is an electrophotographic photoreceptor, and a developer image is formed by causing a developer to adhere to the latent image. At this point, a recording material 2 is conveyed from a recording material supply portion 3 in synchronization with the formation of the developer image, and the developer image formed on the photosensitive drum 5 is transferred onto the recording material 2 by applying a transfer bias to a transfer roller 6 which is transfer means. Subsequently, after fixing the image transferred onto the recording material 2 by fixing means 7, the recording material 2 is discharged to a recording material discharge portion 4. In this case, the apparatus main body A refers to a constituent portion excluding the cartridge B in an apparatus configuration of the image forming apparatus 100.

(Configuration of Process Cartridge)

Figure 3:
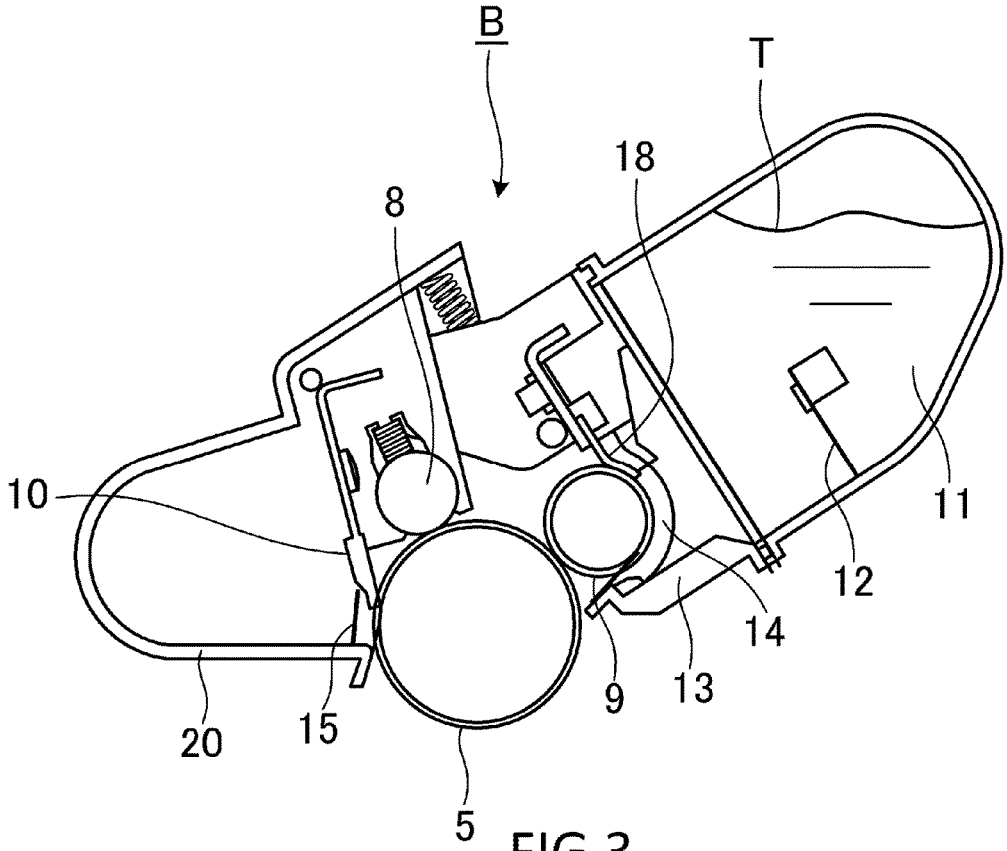
FIG. 3 is a schematic sectional view of a process cartridge according to an embodiment of the present invention.

FIG. 3 is a sectional view showing a configuration of the process cartridge B. The process cartridge B includes the photosensitive drum 5 and at least one processing means which acts on the photosensitive drum 5, and is attachable to and detachable from the apparatus main body A. Processing means include charging means which charges the photosensitive drum 5, developing means which develops the latent image on the photosensitive drum 5, and cleaning means which cleans the developer remaining on the photosensitive drum 5. The process cartridge B according to the present embodiment includes a charging roller 8 as charging means and a cleaning blade 10 as cleaning means. In addition, the process cartridge B includes a developing roller (developer bearing member) 9, a developing blade 18, and the like as developing means.

Furthermore, the process cartridge B includes a developer housing portion 11 which houses a developer T. In the developer housing portion 11, a stirring member 12 for stirring and conveying the developer T is rotatably provided in a housing space of the developer T. A developing frame body 13 is integrally coupled to the developer housing portion 11, and the developing roller 9 is rotatably supported by a bearing (not shown) on the developing frame body 13. Roughly speaking, the process cartridge B is configured so as to unite a cleaning unit and a developing unit. The cleaning unit is constituted by the photosensitive drum 5, a drum frame body 20, the charging roller 8, the cleaning blade 10, and the like. Meanwhile, the developing unit is constituted by a developer container made up of the developer housing portion 11 and the developing frame body 13, a developing blade 18, the developing roller 9, the stirring member 12, a toner T, and the like.

The developer T housed in the developer housing portion 11 passes through an opening provided on the developing frame body 13 and adheres to and is borne on a surface of the developing roller 9. The developing frame body 13 is a member which constitutes a frame body of a developer container in the developing apparatus together with a frame body which constitutes the developer housing portion 11 and is a member which forms an opening of the frame body of the developer container. The developing roller 9 is rotatably provided in the opening. The developer T is supplied to the surface of the developing roller 9 from inside the developer housing portion 11 via the opening provided on the developing frame body 13, and is carried on the rotating developing roller 9 to the outside. The developer adhered to the developing roller 9 passes through the opening of the developing frame body 13 and is carried outside while being subjected to restrictions in an amount of adherence to the surface of the developing roller 9 by the developing blade 18 as a developer layer thickness restricting member. In order to prevent the developer T from leaking to the outside from between the opening of the developing frame body 13 and the developing roller 9 with the exception of being conveyed by the surface of the developing roller 9, a seal member 14 is provided at both ends in an axial direction of a rotary shaft of the developing roller 9. The seal member 14 seals a gap between the opening of the developing frame body 13 and the developing roller 9 and the developing blade 18 in a peripheral region of an end in the axial direction of the rotary shaft of the developing roller 9 so that the developer T does not leak out.

In addition, the photosensitive drum 5 is rotatably supported to a drum frame body 20 by a bearing (not shown). Furthermore, a seal member 15 is provided at both ends in an axial direction of the photosensitive drum 5 so that the developer does not leak out from between the photosensitive drum 5 and the drum frame body 20. While the seal member 14 provided at both ends of the developing roller 9 will be hereinafter described as a seal member to which the present invention is applied, the present invention is also applicable to other similar components such as the seal member 15 provided at both ends of the photosensitive drum 5. In this case, the developing frame body 13 is replaced by the drum frame body 20, the developing roller 9 is replaced by the photosensitive drum 5, and the developing blade 18 is replaced by the cleaning blade 10.

(Configuration of Seal Member)

Figure 4:
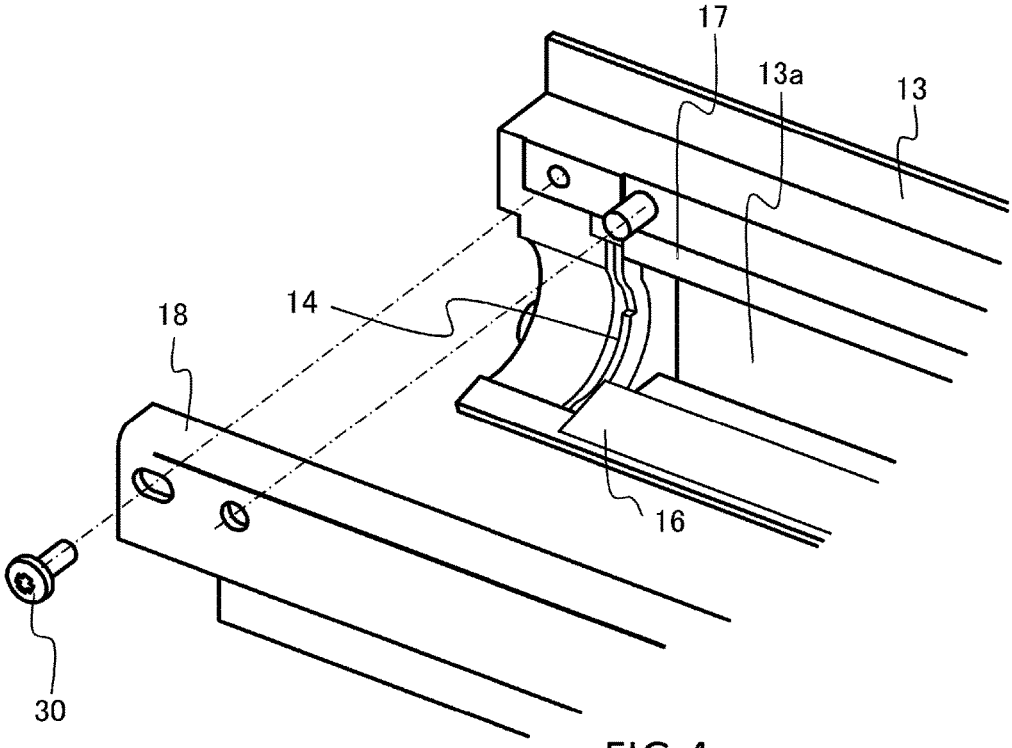
FIG. 4 is a schematic diagram of a process cartridge in which a seal member according to the first embodiment of the present invention is arranged.
Figure 5B:
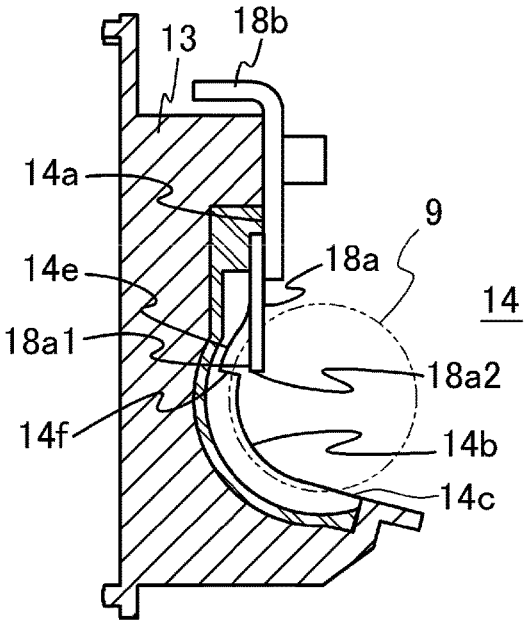
FIGS. 5A to 5C are schematic diagrams of a process cartridge in which a seal member according to the first embodiment of the present invention is arranged.
Figure 5A:
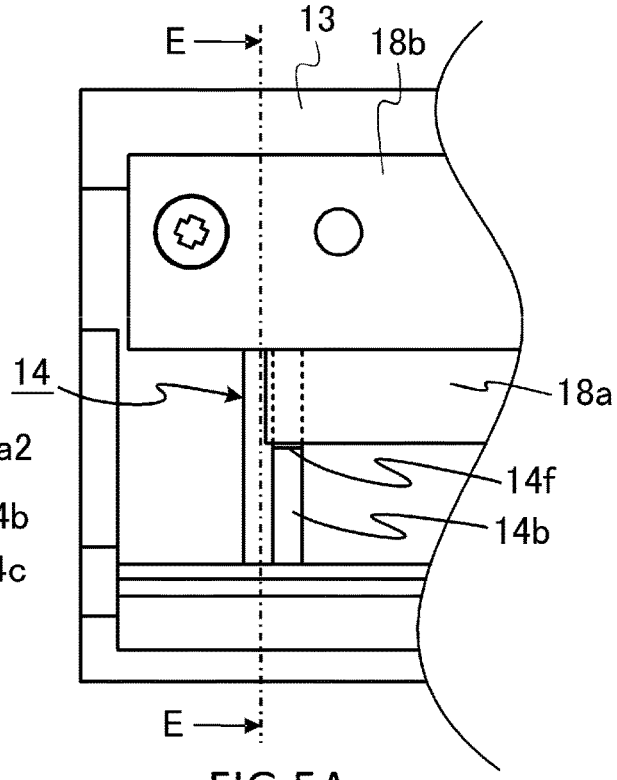
Figure 5C:
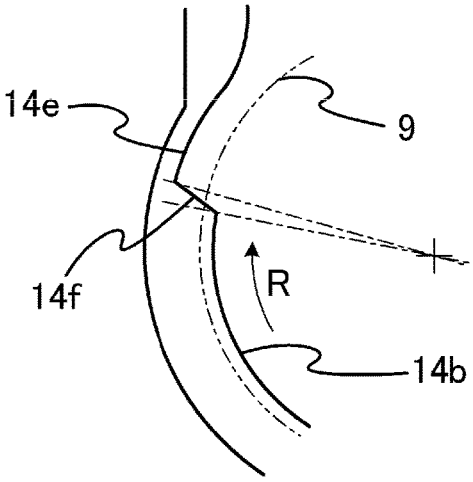

A configuration of a seal member according to the present embodiment will be described with reference to FIGS. 4 to 5C. FIG. 4 is a schematic exploded perspective view showing a periphery of the seal member 14 when attaching the developing blade 18 of the process cartridge B according to the present embodiment. FIGS. 5A to 5C are schematic diagrams showing a state where the developing blade 18 has been attached to the developing frame body 13. Since the developing roller 9 has not yet been mounted, the developing roller 9 is represented in the drawing by a two-dot chain line arc. FIG. 5A is a view of the developing frame body 13 from a side of a position where the developing roller 9 is to be attached. FIG. 5B is a sectional view taken along E-E in FIG. 5A (the developing roller 9 is not shown in FIG. 5A). FIG. 5C is an enlarged view of a stepped portion 14*f* to be described later. In FIG. 5C, R represents a direction in which the developing roller 9 rotates.

The developing frame body 13 has an opening 13*a* for receiving the developer T conveyed from the developer housing portion 11 and for guiding the developer T to the surface of the developing roller 9. In addition, a longitudinal seal member 16, the seal member 14, and a blade seal member 17 are provided so as to surround the opening 13*a*. The developing blade 18 is constituted by a blade 18*a* made of polyurethane rubber as a blade portion and a metallic blade supporting plate 18*b* as a blade portion supporting portion, and is fixed to the developing frame body 13 by a screw 30. The longitudinal seal member 16 seals between the developing frame body 13 and the developing roller 9 over an approximately entire region in a longitudinal direction of the developing roller 9, and the blade seal member 17 seals between the developing frame body 13 and the developing blade 18 over an approximately entire region in a longitudinal direction of the developing blade 18. In addition, the seal member 14 comes into contact with the longitudinal seal member 16, the blade seal member 17, the blade 18*a*, and the developing roller 9 to prevent leaking of the developer from a contact portion with each member at both end regions in the longitudinal direction of the developing roller 9 (the developing blade 18).

The seal member 14 according to the present embodiment is formed of an elastic body (a rubber-like elastic body) such as an elastomer resin or rubber and is attached to the developing frame body 13. A method of attaching the seal member 14 to the developing frame body 13 is not particularly limited and the seal member 14 may be bonded by an adhesive or the like or may be integrally molded to the developing frame body 13. Roughly speaking, the seal member 14 is formed on a surface opposing a peripheral surface of the developing roller 9 on the developing frame body 13 and is configured to protrude toward and come into contact with the peripheral surface of the developing roller 9 from the opposing surface. The seal member 14 sequentially has shapes such as a supporting plate contact portion 14*a* which comes into contact with the blade supporting plate 18*b*, a blade contact portion 14*e* which comes into contact with the blade 18*a*, a rotating body contact portion 14*b* which comes into contact with the developing roller 9, and a longitudinal seal contact portion 14*c* which comes into contact with the longitudinal seal member 16. The rotating body contact portion 14*b* as a first seal portion is formed by an arc portion which is concentric with the rotary shaft of the developing roller 9 and which has a smaller diameter than the developing roller 9. The blade contact portion 14*e* as a second seal portion also has an arc portion which is concentric with the developing roller 9 in a similar manner to the rotating body contact portion 14*b*. The arc portion has a diameter that is larger than that of the rotating body contact portion 14*b* by a distance equal to or less than a thickness of the blade 18*a*. The blade contact portion 14*e* is constituted by a first portion which closely adheres to the blade 18*a* before assembly of the developing roller 9 and during assembly of the developing blade 18 (a portion in contact with the blade 18*a* in FIG. 5B) and a second portion which is a portion other than the first portion and which closely adheres to the blade 18*a* during assembly of the developing roller 9.

Furthermore, the seal member 14 includes a stepped portion 14*f* as a third seal portion that is a portion which comes into contact with a tip surface 18*a*2 of the blade 18*a* and which connects the rotating body contact portion 14*b* and the blade contact portion 14*e* with each other. As shown in FIG. 5C, the stepped portion 14*f* continues inclined from the blade contact portion 14*e* toward an upstream side in a rotation direction during image formation of the developing roller 9 and toward the rotating body contact portion (14*b*).

Specifically, the rotating body contact portion 14*b* includes an arc-shaped contact surface centered on the rotary shaft of the developing roller 9 as a first contact surface which comes into contact with the developing roller 9. In addition, as a second contact surface which comes into contact with the blade 18*a*, the blade contact portion 14*e* includes an arc-shaped contact surface which is centered on the rotary shaft of the developing roller 9 and of which a distance from the rotary shaft of the developing roller 9 is longer than that of the contact surface of the rotating body contact portion 14*b*. Furthermore, as a third contact surface, the stepped portion 14*f* includes a contact surface that is a surface which connects between the contact surface of the rotating body contact portion 14*b* and the contact surface of the blade contact portion 14*e* and which extends in a direction inclined with respect to a radial direction of an imaginary circle centered on the rotary shaft of the developing roller 9. The contact surface of the stepped portion 14*f* is a surface which, in a state before assembly of the developing roller 9 and the developing blade 18, extends in a direction inclined with respect to a direction in which the end surface 18*a*2 of the tip portion of the blade 18*a* extends when the developing roller 9 and the developing blade 18 are assembled to the developing frame body 13. The stepped portion 14*f* comes into contact with the end surface 18*a*2 of the tip portion of the blade 18*a* with which the blade contact portion 14*e* does not come into contact and a region which is a region of the surface of the developing roller 9 adjacent to the end surface 18*a*2 and with which the rotating body contact portion 14*b* does not come into contact. The respective seal portions of the rotating body contact portion 14*b*, the blade contact portion 14*e*, and the stepped portion 14*f* have a same width in a rotational axis direction of the developing roller 9, and the respective contact surfaces also have a same width in the same direction.

Figure 1B:
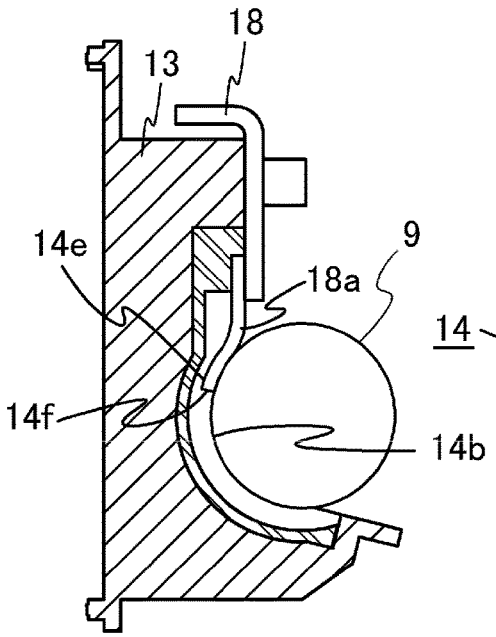
FIGS. 1A to 1D are schematic diagrams of a process cartridge in which a seal member according to a first embodiment of the present invention is arranged.
Figure 1A:
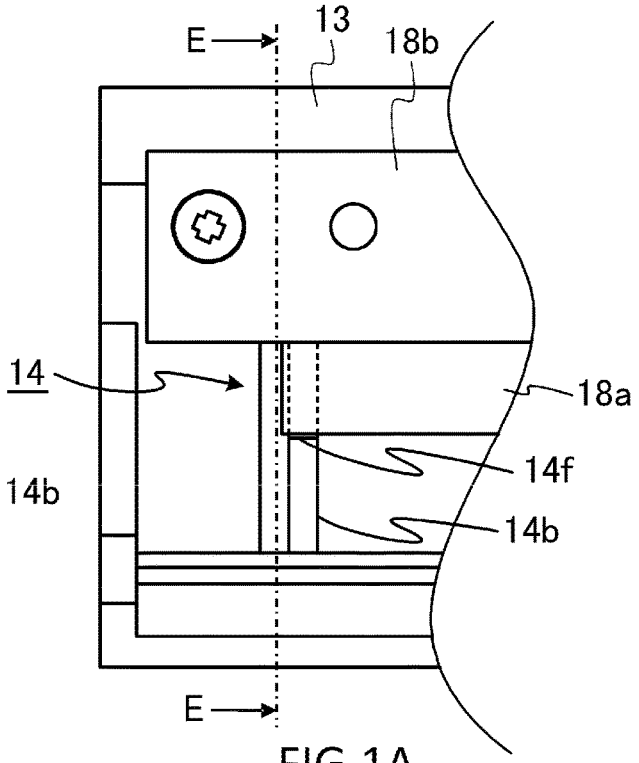
Figure 1C:
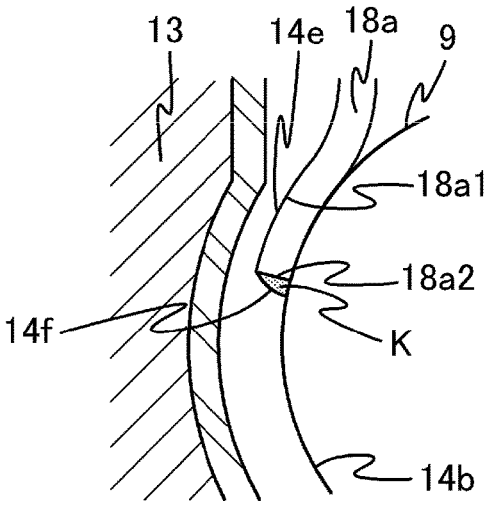
Figure 1D:
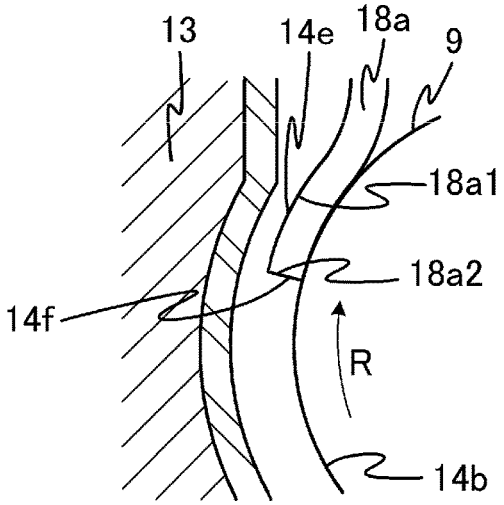

FIGS. 1A to 1D are diagrams explaining a state where the developing roller 9 is assembled with respect to the state shown in FIGS. 5A to 5C. FIG. 1A is a view of the developing frame body 13 seeing from a side of a position where the developing roller 9 is attached, in which the developing roller 9 has been omitted in order to facilitate understanding of the configuration. FIG. 1B is a sectional view cut along E-E in FIG. 1A. In addition, FIGS. 1C and 1D are enlarged views in the axial direction of the rotary shaft of the developing roller 9 of a periphery of a position where the developing roller 9, the seal member 14, and the blade 18*a* come into contact with one another. FIG. 1C shows a stationary state after the developing roller 9 is assembled and before the developing roller 9 is rotated or, in other words, a state where the developing roller 9 is stopped before rotating for the first time. FIG. 1D shows a rotating state of the developing roller 9 or, in other words, a state after the developing roller 9 has started rotating for the first time.

Assembly of the developing roller 9 causes the blade 18*a* and the rotating body contact portion 14*b* to deform so as to conform to an outer circumferential surface of the developing roller 9 and causes the rotating body contact portion 14*b* to be compressed in the radial direction by the developing roller 9. In addition, the deformation of the blade 18*a* causes the blade contact portion 14*e* to be compressed so as to conform to a surface 18*a*1 of the blade 18*a* on a side which does not come into contact with the developing roller 9. Accordingly, the rotating body contact portion 14*b* closely adheres to the developing roller 9 and the blade contact portion 14*e* closely adheres to the blade 18*a*. When the developing roller 9 is still in a stationary state immediately after assembly, the tip surface 18*a*2 of the blade 18*a* and the stepped portion 14*f* of the seal member 14 are either in a state of partial contact or in a completely noncontact state. At this point, a stepped gap K enclosed by the developing roller 9, the stepped portion 14*f* of the seal member 14, and the tip surface 18*a*2 of the blade 18*a* is created (FIG. 1C). The stepped gap K is a gap in which a distance between the stepped portion 14*f* and the tip surface 18*a*2 of the blade 18*a* broadens in a rotation direction of the developing roller 9 towards the surface of the developing roller 9.

The reason for creating the stepped gap K will now be described. Normally, in order to prevent a developer from leaking, respective members must be arranged so as to adequately adhere to one another to fill the gaps between the members. Achieving this requires creating a state immediately after assembly of the developing roller 9 where such gaps are not created. However, in this case, a part of the seal member 14 may already be caught between the developing roller 9 and the blade 18*a* immediately after assembly of the developing roller 9 or may get caught between the developing roller 9 and the blade 18*a* when the developing roller 9 rotates in the rotation direction R during image formation and, consequently, there is a risk of a gap being created. In consideration thereof, in the present embodiment, a configuration is adopted in which a gap is created between the stepped portion 14*f* of the seal member 14 and the tip surface 18*a*2 of the blade 18*a* during assembly of the developing roller 9 in order to achieve both prevention of catching and seal performance.

A side near the rotating body contact portion 14*b* of the stepped portion 14*f* having a particularly high risk of getting caught is arranged more on an upstream side of the rotation direction of the developing roller 9 than a side near the blade contact portion 14*e* of the stepped portion 14*f*. Even in a case where the stepped gap K is created, when the developing roller 9 rotates in the rotation direction R as shown in FIG. 1D, the rotating body contact portion 14*b* also rotates and moves due to friction force, and the stepped portion 14*f* also moves following the rotation and movement of the rotating body contact portion 14*b* and closely adheres to the tip surface 18*a*2 to exhibit seal performance. In other words, as shown in FIG. 1C, before the developing roller 9 rotates for the first time, the stepped portion 14*f* is in a state where the stepped gap K is formed as a first state. In addition, the stepped portion 14*f* deforms as the developing roller 9 rotates for the first time and, as shown in FIG. 1D, enters a state where the stepped gap K is filled or a state where the stepped gap K is narrowed to such a degree that sufficient seal performance is exhibited as a second state. Specifically, surfaces formed in a stair pattern are sequentially formed as the stepped portion 14*f* between the rotating body contact portion 14*b* and the blade contact portion 14*e* and, due to rotation of the developing roller 9, a gap formed between the developing roller 9 and the developing blade 18 decreases. The deformation of the stepped portion 14*f* that is sequentially arranged between the rotating body contact portion 14*b* and the blade contact portion 14*e* is a deformation such that, while filling the stepped gap K or while narrowing the stepped gap K, a portion that is sandwiched between the developing roller 9 and the blade 18*a* is not created in the stepped portion 14*f*.

A size of the stepped gap K changes due to dimensional tolerance, assembly tolerance and so on of the seal member 14 and the blade 18*a*. However, by appropriately selecting an angle of inclination of the stepped portion 14*f* and/or a shape of the inclined portion (in addition to a straight line, a curved line or a combination thereof), the stepped portion 14*f* can be configured so as to move following the rotation of the developing roller 9 until closely adhering with the tip surface 18*a*2. Therefore, even if the size of the stepped gap K differs, seal performance can be exhibited. After rotation of the developing roller 9, since friction force between the developing roller 9 and the rotating body contact portion 14*b* enables the stepped portion 14*f* to maintain close adherence with the tip surface 18*a*2, seal performance is maintained without the stepped gap K created once again.

Second Embodiment

Figure 6B:
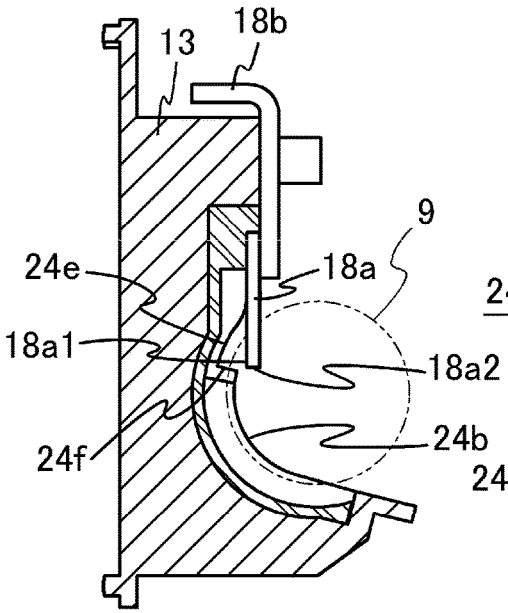
FIGS. 6A to 6C are schematic diagrams of a process cartridge in which a seal member according to a second embodiment of the present invention is arranged.
Figure 6A:
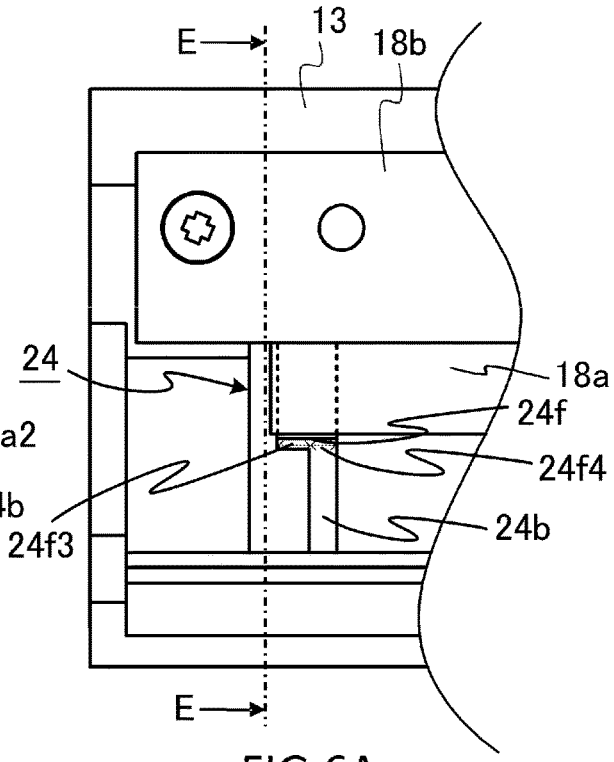
Figure 6C:
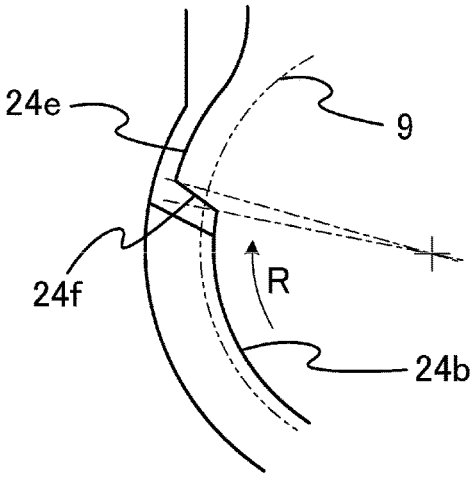

A configuration of a second embodiment of the present invention will now be described with reference to FIGS. 6A to 8. FIGS. 6A to 6C are diagrams showing the seal member 14 shown in FIGS. 5A to 5C being replaced by a seal member 24 according to the present embodiment. In a similar manner, FIGS. 7A to 7D are diagrams showing the seal member 14 shown in FIGS. 1A to 1D being replaced by the seal member 24, and FIG. 8 is a diagram showing the seal member 14 shown in FIG. 4 being replaced by the seal member 24. In the second embodiment, components in common with those of the first embodiment are assigned same reference characters and descriptions thereof will be omitted. Matters not described in the second embodiment are similar to those described in the first embodiment.

As shown in FIG. 6A, a stepped portion 24*f* of the seal member 24 according to the present embodiment has a shape that is more elongated in an outer side direction (a leftward direction in FIG. 6A) of the frame body 13 than a rotating body contact portion 24*b* along a longitudinal direction of the blade 18*a*. Specifically, the stepped portion 24*f* as a third seal portion includes a portion 24*f*4 (a coupled portion) that continues to the rotating body contact portion 24*b* as a first seal portion in a circumferential direction of the developing roller 9 and a portion (side end portion) 24*f*3 (a non-coupled portion) that does not continue to the rotating body contact portion 24*b*. Unlike a stepped portion 34*f* of a seal member 34 according to a third embodiment to be described later, the coupled portion and the non-coupled portion are integrally continuous in the axial direction of the developing roller 9 in the stepped portion 24*f* according to the present embodiment. Among widths of the respective seal portions in the axial direction of the developing roller 9, widths of a blade contact portion 24*e* as a second seal portion and the stepped portion 24*f* are the same, the rotating body contact portion 24*b* is shorter than the other two seal portions, and contact surfaces of the respective seal portions have a similar width relationship.

Figure 7B:
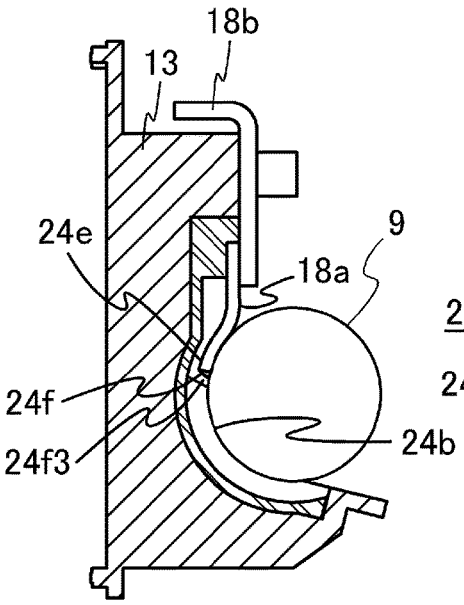
FIGS. 7A to 7D are schematic diagrams of a process cartridge in which a seal member according to the second embodiment of the present invention is arranged.
Figure 7A:
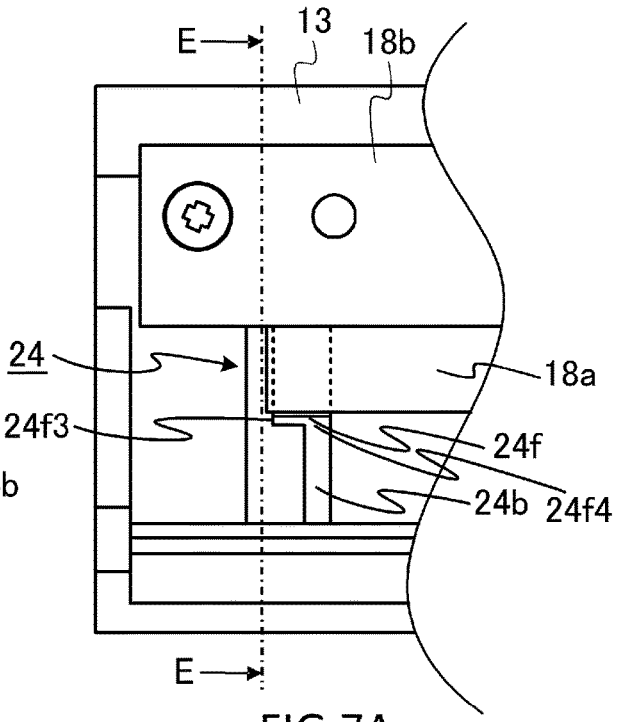
Figure 7C:
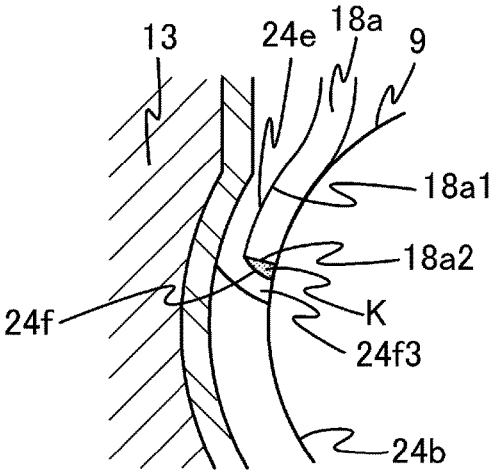
Figure 7D:
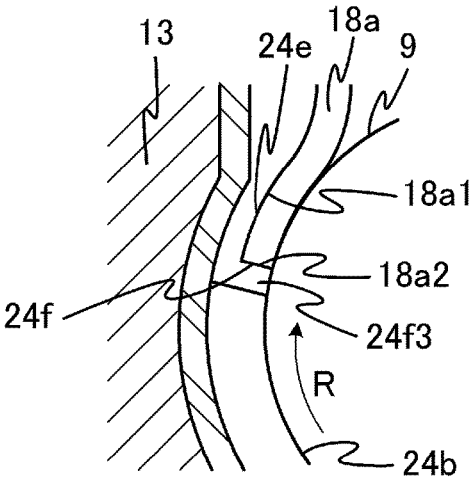
Figure 8:
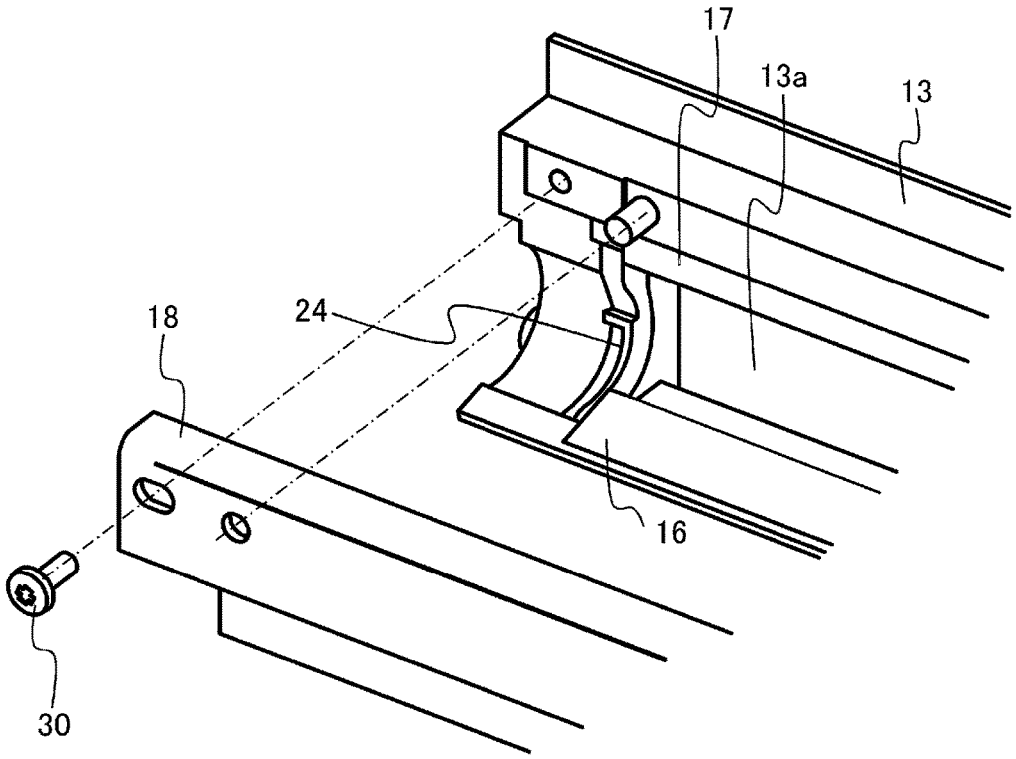
FIG. 8 is a schematic diagram of a process cartridge in which a seal member according to the second embodiment of the present invention is arranged.

When the developing roller 9 is assembled, the blade 18*a* and the seal member 24 deform as shown in FIG. 7B. Accordingly, the rotating body contact portion 24*b* closely adheres to the developing roller 9 and the blade contact portion 24*e* closely adheres to the surface 18*a*1 of the blade 18*a* that does not come into contact with the developing roller 9. In addition, a configuration is adopted in a similar manner to the first embodiment such that, as shown in FIG. 7C, a stepped gap K enclosed by the developing roller 9, the stepped portion 24*f* of the seal member 24, and the tip surface 18*a*2 of the blade 18*a* is created. The fact that seal performance is exhibited as the stepped portion 24*f* closely adheres to the tip surface 18*a*2 following rotation of the developing roller 9 is also similar to the first embodiment.

In the second embodiment, a width of the stepped portion 24*f* in the axial direction of the developing roller 9 is configured so as to be wider than that of the rotating body contact portion 24*b*, which contrasts with the first embodiment in which both widths are the same. Specifically, the stepped portion 24*f* according to the present embodiment is configured so as to include the portion 24*f*4 (the coupled portion) that is supported by the rotating body contact portion 24*b* in the rotation direction of the developing roller 9 and the portion 24*f*3 (the non-coupled portion) that is not directly supported by the rotating body contact portion 24*b*. Accordingly, the stepped portion 24*f* according to the present embodiment is to include the portion 24*f*3 (the non-coupled portion) where deformation is likely to occur due to sliding with the developing roller 9 and the portion 24*f*4 (the coupled portion) where deformation is less likely to occur. Since the non-coupled portion 24*f*3 of the stepped portion 24*f* is formed separated from the rotating body contact portion 24*b* and is capable of moving flexibly, the non-coupled portion 24*f*3 more readily closely adheres to the tip surface 18*a*2 than the coupled portion 24*f*4 when the developing roller 9 rotates. In addition, a surface of the seal member 24 which comes into sliding contact with the rotating developing roller 9 is configured such that an area of the surface over the entire seal member 24 is relatively wider in the axial direction of the developing roller 9 in a stepped portion formed by the developing roller 9 and the developing blade 18 where leakage is particularly likely to occur. Accordingly, adherence and seal performance of the seal member 24 can be improved.

Moreover, while the stepped portion 24*f* according to the present embodiment is configured such that the non-coupled portion 24*f*3 is arranged on an outer side in the axial direction of the developing roller 9 relative to the coupled portion 24*f*4, the configuration of the stepped portion 24*f* is not limited thereto. The non-coupled portion 24*f*3 may be arranged on an inner side in the axial direction of the developing roller 9 relative to the coupled portion 24*f*4 or the non-coupled portion 24*f*3 may be arranged on both sides of the coupled portion 24*f*4 in the axial direction.

Third Embodiment

Figure 9B:
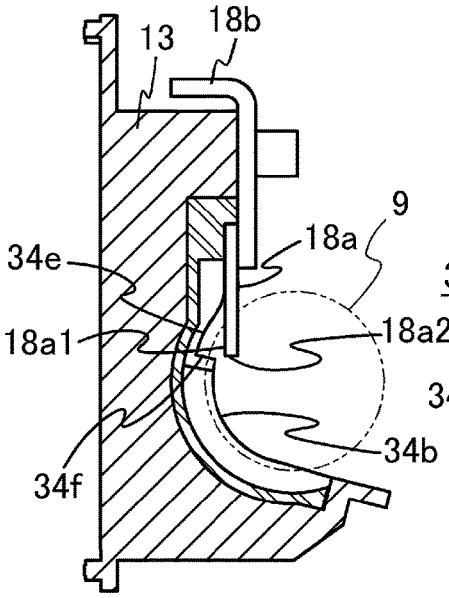
FIGS. 9A to 9C are schematic diagrams of a process cartridge in which a seal member according to a third embodiment of the present invention is arranged.
Figure 9A:
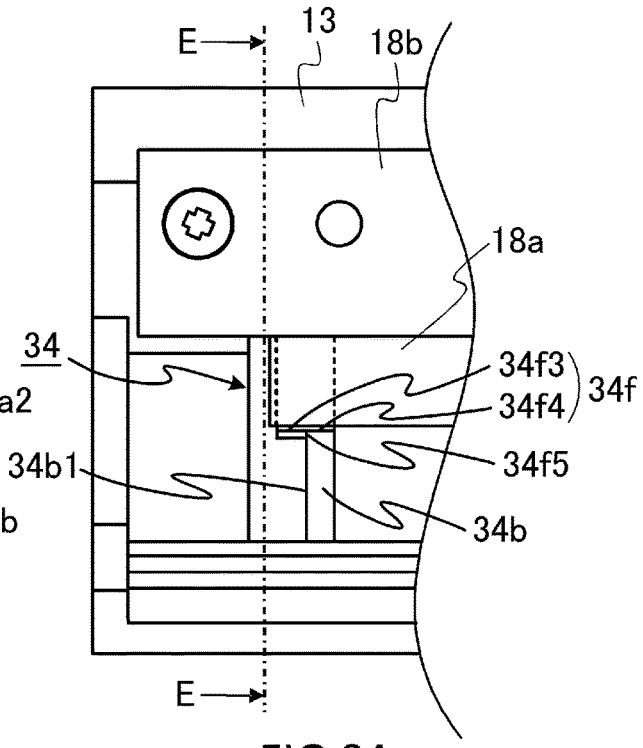
Figure 9C:
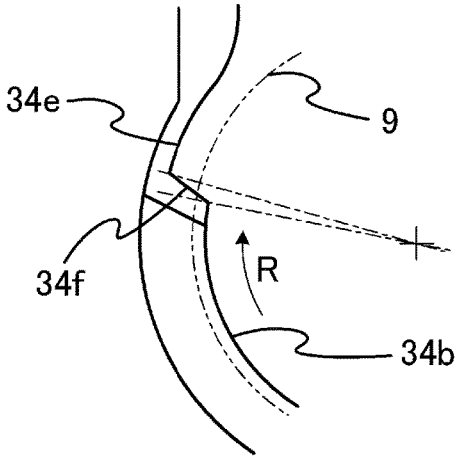

A configuration of a third embodiment of the present invention will now be described with reference to FIGS. 9A to 11B. FIGS. 9A to 9C are diagrams showing the seal member 24 shown in FIGS. 6A to 6C being replaced by a seal member 34 according to the present embodiment. In a similar manner, FIGS. 10A to 10D are diagrams showing the seal member 24 shown in FIGS. 7A to 7D being replaced by the seal member 34, and FIG. 11A is a diagram showing the seal member 24 shown in FIG. 8 being replaced by the seal member 34. In addition, FIG. 11B is a diagram showing an enlargement of a periphery of the seal member 34 shown in FIG. 11A. In the third embodiment, components in common with those of the first and second embodiments are assigned same reference characters and descriptions thereof will be omitted. Matters not described in the third embodiment are similar to those described in the first and second embodiments.

As shown in FIGS. 9A and 11B, the stepped portion 34*f* of the seal member 34 according to the present embodiment is divided by a division surface 34*f*5 in an in-plane direction of a side surface 34*b*1 of a rotating body contact portion 34*b* and includes a first stepped portion 34*f*3 and a second stepped portion 34*f*4. The first stepped portion 34*f*3 as a non-coupled portion is independent of the rotating body contact portion 34*b*, and the second stepped portion 34*f*4 as a coupled portion is integrated with the rotating body contact portion 34*b* as a first seal portion. The first stepped portion 34*f*3 and the second stepped portion 34*f*4 are in contact with each other in the axial direction of the developing roller 9 at the division surface 34*f*5 so as to be mutually slidably movable, and prevent leakage of the developer.

Figure 10B:
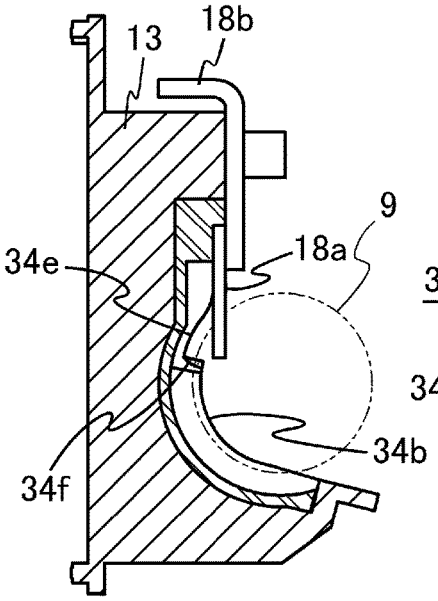
FIGS. 10A to 10D are schematic diagrams of a process cartridge in which a seal member according to the third embodiment of the present invention is arranged.
Figure 10A:
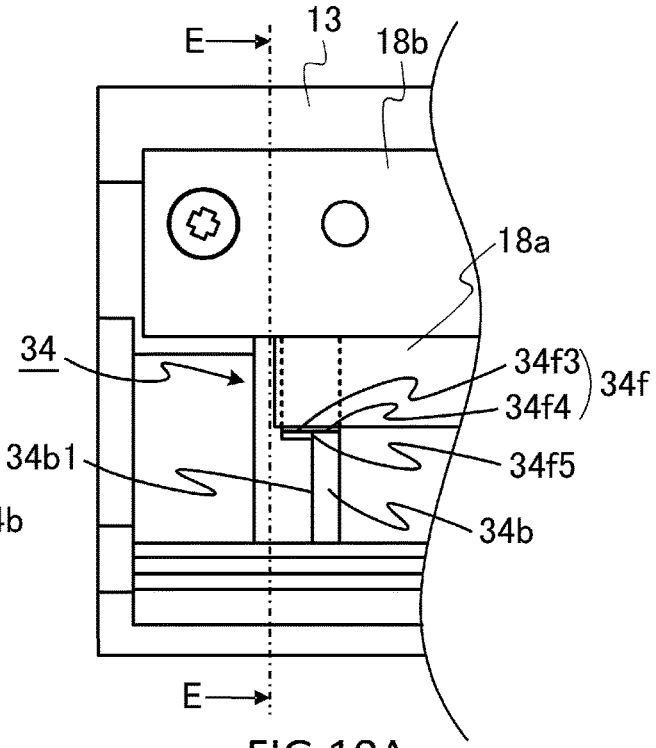
Figure 10C:
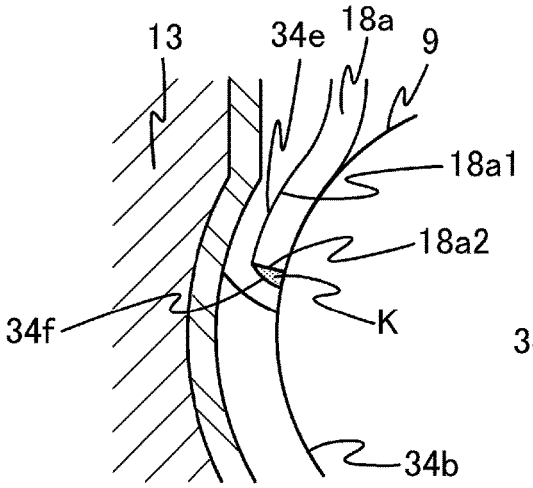
Figure 10D:
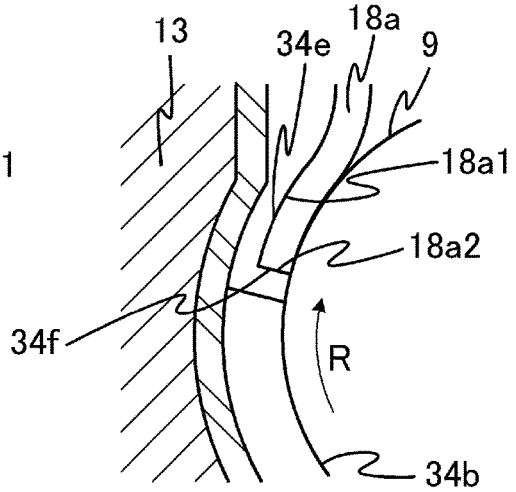
Figure 11A:
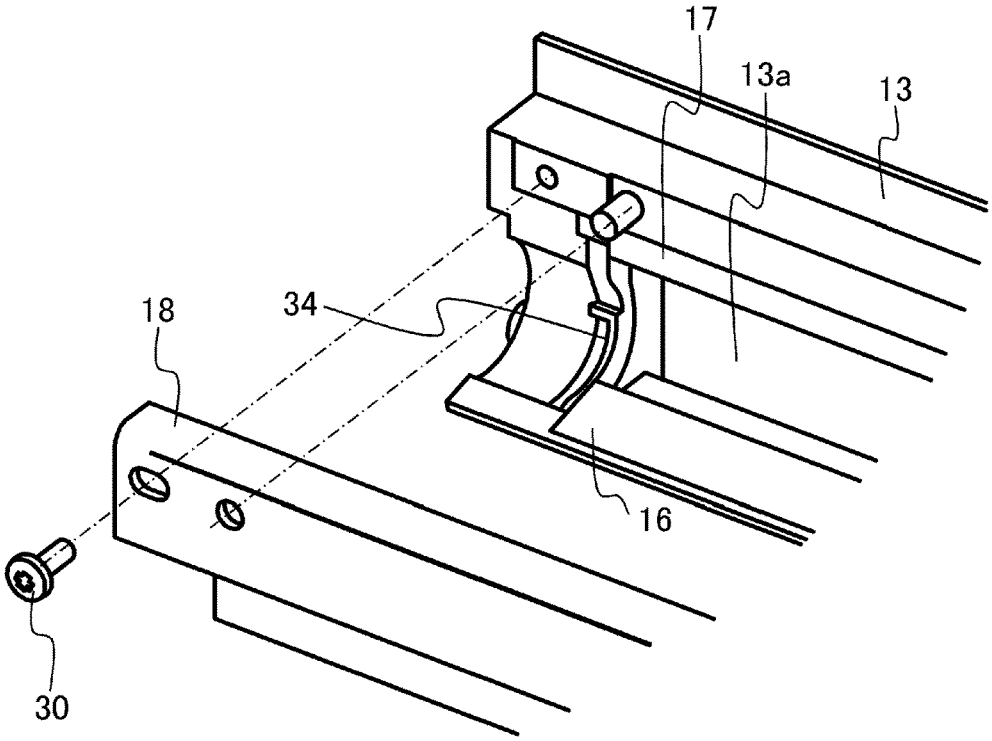
FIGS. 11A and 11B are schematic diagrams of a process cartridge in which a seal member according to the third embodiment of the present invention is arranged.
Figure 11B:
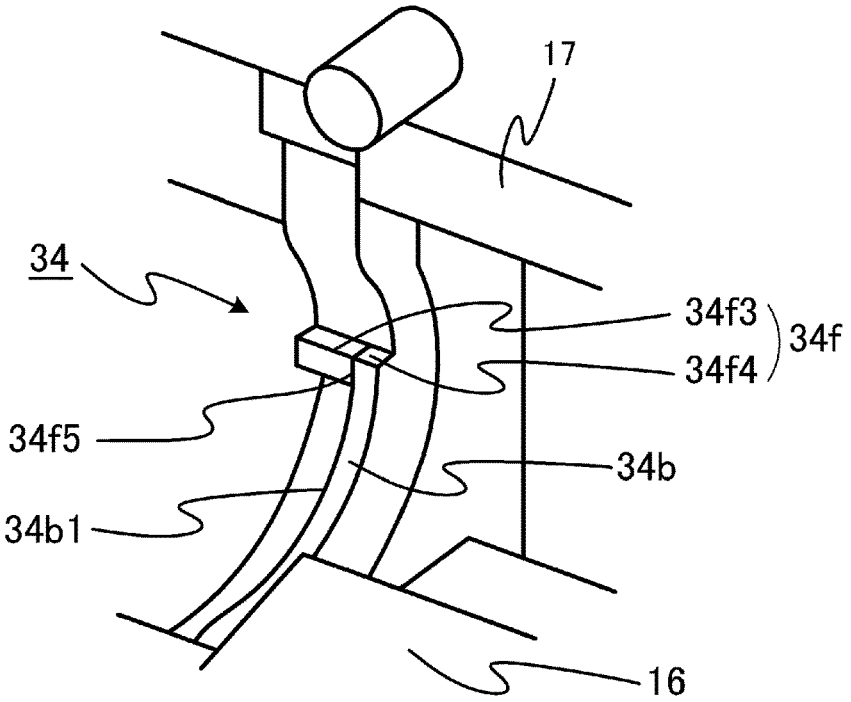

When the developing roller 9 is assembled, the blade 18*a* and the seal member 34 deform as shown in FIG. 10B. Accordingly, the rotating body contact portion 34*b* closely adheres to the developing roller 9 and the blade contact portion 34*e* closely adheres to the surface 18*a*1 that does not come into contact with the developing roller 9 of the blade 18*a*. In addition, a configuration is adopted in a similar manner to the first and second embodiments such that, as shown in FIG. 10C, a stepped gap K enclosed by the developing roller 9, the stepped portion 34*f* of the seal member 34, and the tip surface 18*a*2 of the blade 18*a* is created. The fact that seal performance is exhibited as the stepped portion 34*f* closely adheres to the tip surface 18*a*2 following rotation of the developing roller 9 is also similar to the first and second embodiments.

In the third embodiment, the stepped portion 34*f* is constituted by the first stepped portion 34*f*3 and the second stepped portion 34*f*4, and the first stepped portion 34*f*3 is capable of moving more flexibly than the second stepped portion 34*f*4. This is because, due to being independent of the rotating body contact portion 34*b*, the first stepped portion 34*f*3 more readily follows rotation of the developing roller 9. Accordingly, when the developing roller 9 rotates, the first stepped portion 34*f*3 and the tip surface 18*a*2 more readily closely adhere than the first and second embodiments. As a result, seal performance can be further improved.

Moreover, according to the present embodiment, contact pressure between the second stepped portion 34*f*4 and the tip surface 18*a*2 can be lowered as compared to the stepped portion 14*f* according to the first embodiment and the stepped portion 24*f* according to the second embodiment. This is because an improvement in seal performance achieved by the first stepped portion 34*f*3 enables seal performance at the second stepped portion 34*f*4 to be eased. Accordingly, at the second stepped portion 34*f*4, an occurrence of catching between the developing roller 9 and the developing blade 18 can be further suppressed. As described above, the seal member 34 can be made less susceptible to catching while further improving seal performance.

Moreover, while the stepped portion 34*f* according to the present embodiment is configured such that the first stepped portion 34*f*3 is arranged on an outer side in the axial direction of the developing roller 9 relative to the second stepped portion 34*f*4, the configuration of the stepped portion 34*f* is not limited thereto. The first stepped portion 34*f*3 may be arranged on an inner side in the axial direction of the developing roller 9 relative to the second stepped portion 34*f*4 or the first stepped portion 34*f*3 may be arranged on both sides of the second stepped portion 34*f*4 in the axial direction.

Configurations of the respective embodiments described above can be mutually combined to the greatest extent feasible. In addition, while the respective embodiments described above represent applications of the present invention in a seal member of a developing unit, configurations to which the present invention is applicable are not limited to the respective embodiments described above. For example, the present invention is also applicable to a seal configuration for preventing leakage of waste toner from a waste toner chamber of the drum frame body 20 in a cleaning unit or, in other words, to a seal member which is provided on the drum frame body 20 and which abuts or comes into sliding contact with the cleaning blade 10 or the photosensitive drum 5.

In addition, while only the seal configuration at one end among both ends in the axial direction of the developing roller 9 has been described in the description of the respective embodiments presented above, the other end has a similar seal configuration. Specifically, with respect to the seal configuration at the one end, the seal configuration at the other hand has a symmetrical (inverse) relationship in terms of an arrangement and a configuration in an axial direction and the like and is no different as far as functions and the like are concerned.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-014998, filed on Jan. 29, 2016, which is hereby incorporated by reference herein in its entirety.

What is claimed is:

1. A seal member used in a cartridge or an image forming apparatus including a frame body which is provided with a housing portion for housing a developer, a roller which is provided so as to face an opening of the housing portion of the frame body, and a blade which comes into contact with a surface of the roller, the seal member to be provided on a region of the frame body outside the opening of the housing portion in an axial direction of the roller, so as to seal a gap between the frame body and the roller and a gap between the blade and the frame body to prevent a leakage of the developer, the seal member comprising:

a first surface which is configured to come into contact with the roller;

a second surface which is configured to come into contact with a surface of the blade opposite to a surface of the blade contacting the roller, wherein, in a case where the seal member is provided on the frame body and the roller is not provided on the frame body, the second surface (i) is recessed, with respect to the first surface, in a direction approaching the frame body and (ii) includes an arc shaped part protruding in the direction approaching the frame body when viewed in the axial direction of the roller, and wherein, in a case where both the seal member and the roller are provided on the frame body, the arc shaped part of the second surface comes into contact with the surface of the blade opposite to the surface of the blade contacting the roller; and a third surface continuously arranged between the first surface and the second surface, wherein in a case where both the seal member and the roller are provided on the frame body, the third surface faces a tip of the blade when viewed in the axial direction of the roller.

2. The seal member according to claim 1, wherein in a case where both the seal member and the roller are provided on the frame body, widths of the first surface, the second surface, and the third surface in the axial direction of the roller are the same.

3. The seal member according to claim 1, wherein in a case where both the seal member and the roller are provided on the frame body, the first surface includes a region, farther away from the second surface than a boundary between the first surface and the third surface in the direction along a circumferential surface of the roller, in which a width of the first surface in the axial direction of the roller is narrower than a width of the third surface.

4. The seal member according to claim 1, wherein the seal member is made of an elastomer.

5. A unit attachable to and detachable from an apparatus main body of an image forming apparatus, the unit comprising:

a frame body which is provided with a housing portion for housing a developer;

a roller which is provided so as to face an opening of the housing portion of the frame body;

a blade which comes into contact with a circumferential surface of the roller; and a seal member which is provided on a region of the frame body outside the opening of the housing portion in a axial direction of the roller and extends in a direction along the circumferential surface of the roller, so as to seal a gap between the frame body and the roller and a gap between the blade and the frame body, to prevent a leakage of the developer, the seal member including:

a first surface which comes into contact with the circumferential surface of the roller;

a second surface configured to come into contact with a surface of the blade opposite to a surface of the blade contacting the roller, wherein, in a case where the roller is not provided on the frame body, the second surface (i) is recessed, with respect to the first surface, in a direction approaching the frame body and (ii) includes an arc shaped part protruding in the direction approaching the frame body when viewed in the axial direction of the roller, and wherein, in a case where the roller is provided on the frame body, the arc shaped part of the second surface comes into contact with the surface of the blade opposite to the surface of the blade contacting the roller; and a third surface which is continuously arranged between the first surface and the second surface, wherein the third surface faces a tip of the blade when viewed in the axial direction of the roller.

6. The unit according to claim 5, wherein the roller is a developer bearing member which bears a developer to be used in development of an electrostatic image formed on an image bearing member.

7. The unit according to claim 5, wherein the blade comes into contact with the circumferential surface of the roller so as to restrict an amount of the developer which is borne by the roller and which is carried outside through the opening.

8. The unit according to claim 5, wherein a rotation of the roller causes the seal member to deform so that a gap between the third surface of the seal member and the tip of the blade is reduced.

9. The unit according to claim 5, wherein widths of the first surface, the second surface, and the third surface in the axial direction of the roller are the same.

10. The unit according to claim 5, wherein the first surface of the seal member includes a region, farther away from the second surface than a boundary between the first surface and the third surface in the direction along the circumferential surface of the roller, in which a width of the first surface of the seal member in the axial direction of the roller is narrower than a width of the third surface of the seal member.

11. The unit according to claim 5, wherein the seal member is made of an elastomer.

12. The unit according to claim 5, wherein the blade is made of rubber.

13. The unit according to claim 5, wherein the seal member is integrally molded with the frame body.

14. A unit attachable to and detachable from an apparatus main body of an image forming apparatus, the unit comprising:

a frame body which is provided with a housing portion for housing a developer;

a roller which is provided so as to face an opening of the housing portion of the frame body;

a blade which comes into contact with a circumferential surface of the roller; and a seal member which is provided on a region of the frame body outside the opening of the housing portion in an axial direction of the roller and extends in a direction along the circumferential surface of the roller, so as to seal a gap between the frame body and the roller and a gap between the blade and the frame body, to prevent a leakage of the developer, the seal member including:

a first surface which comes into contact with the circumferential surface of the roller; and a second surface configured to come into contact with a surface of the blade opposite to a surface of the blade contacting the roller, wherein, in a case where the roller is not provided on the frame body, the second surface (i) is recessed, with respect to the first surface, in a direction approaching the frame body and (ii) includes an arc shaped part protruding in the direction approaching the frame body when viewed in the axial direction of the roller, and wherein, in a case where the roller is provided on the frame body, the arc shaped part of the second surface comes into contact with the surface of the blade opposite to the surface of the blade contacting the roller.

15. The unit according to claim 14, wherein the seal member is integrally molded with the frame body.

* * * * *